US005085900A

United States Patent [19]

Hamlett

[11] Patent Number: 5,085,900

[45] Date of Patent: Feb. 4, 1992

[54] ARTIFICIAL PALM TREE

[76] Inventor: Bob D. Hamlett, 6975 Monticello Rd., Shawnee Mission, Kans. 66226

[21] Appl. No.: 622,540

[22] Filed: Dec. 5, 1990

[51] Int. Cl.[5] ..... A41G 1/00

[52] U.S. Cl. ..... 428/18; 156/61

[58] Field of Search ..... 428/18, 19, 20; 362/123; 156/61, 191

[56] References Cited

U.S. PATENT DOCUMENTS

| | | | |
|---|---|---|---|
| D. 244,570 | 6/1977 | Taylor | 428/18 X |
| 2,070,825 | 2/1937 | Buhrow | 428/18 X |
| 2,080,523 | 5/1937 | Williams et al. | 428/18 |
| 2,093,753 | 9/1937 | Ehler, Jr. | 428/18 |
| 2,251,705 | 8/1941 | Gonzalez | 428/18 X |
| 2,251,706 | 8/1941 | Loewy | 428/18 X |
| 3,144,375 | 8/1964 | Day | 428/18 |
| 3,813,837 | 6/1974 | McClain et al. | 428/188 X |
| 3,896,858 | 7/1975 | Whatley | 428/188 X |
| 4,007,075 | 2/1977 | McClain et al. | 156/191 X |
| 4,727,672 | 3/1988 | Hill et al. | 428/20 X |
| 4,855,167 | 8/1989 | Biehl | 428/18 |

*Primary Examiner*—Henry F. Epstein
*Attorney, Agent, or Firm*—Litman, McMahon & Brown

[57] ABSTRACT

An artificial palm tree apparatus comprises a trunk, having a cylindrically shaped axial cavity, a cylindrically shaped cap having a plurality of cylindrically shaped ferrules rigidly secured to the outer cylindrical surface of the cap such that the axis of each of the ferrules is substantially parallelly aligned with the axis of the cap, a plurality of fronds, and a support tube. The trunk is constructed of long strips of glass fibers embedded in hardened resin. Each of the fronds is constructed of a rod and a plurality of artificial leaves spaced along the rod and secured thereto with an all-weather tape. One of each of the fronds is inserted through one of the ferrules and rigidly secured thereto by tightening a pair of nuts on a threaded end of a respective rod against opposite ends of the respective ferrule. The trunk is installed by embedding a portion of the support tube in the ground and telescoping the trunk cavity over the portion of the support tube extending upwardly from the ground. The cap with fronds secured thereto is telescoped over the upper end of the trunk. A first modified embodiment of the artificial palm tree apparatus has a trunk which is sectioned and one or more couplings for connecting the sections together during installation. A second modified embodiment of the artificial palm tree apparatus has a cap having a plurality of non-cylindrically shaped receivers, each of which operably receives a smaller, similarly shaped insert member rigidly secured to the base end of a respective frond.

17 Claims, 3 Drawing Sheets

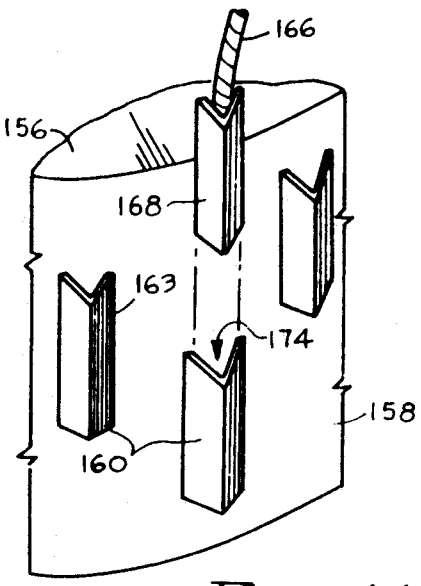
Fig. 11.
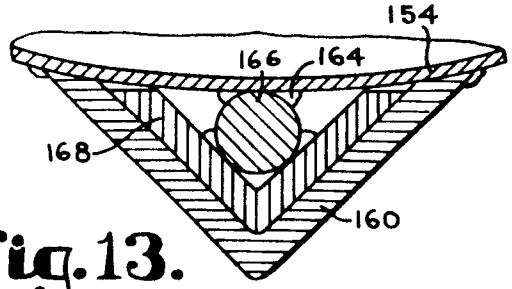
Fig. 13.
Fig. 10.
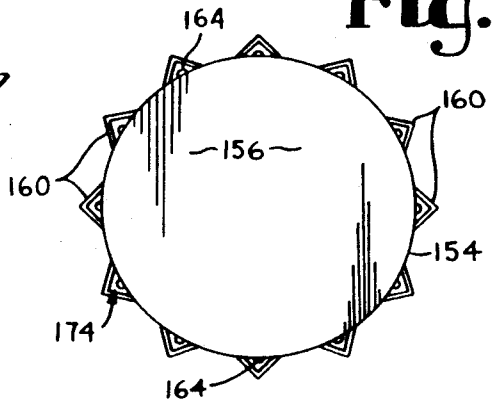
Fig. 12.
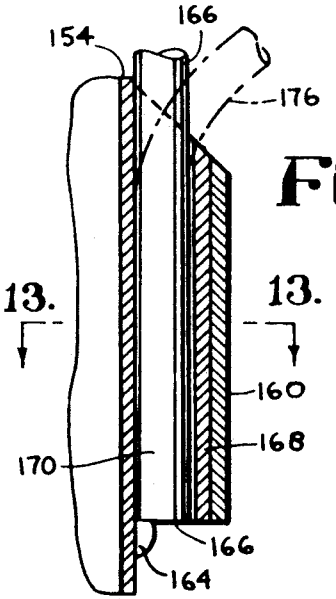
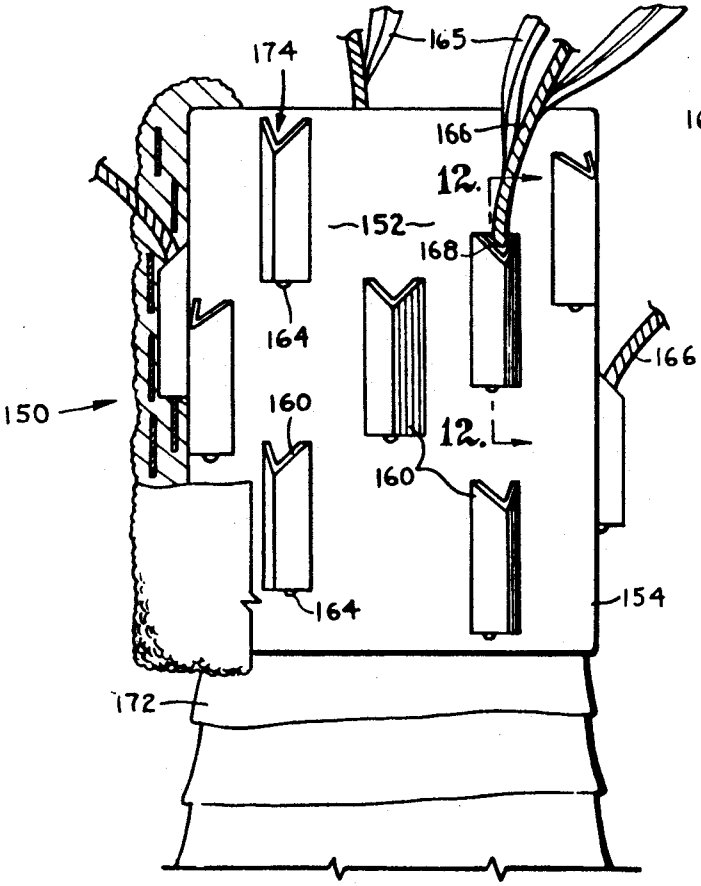
Fig. 9.

ARTIFICIAL PALM TREE

BACKGROUND OF THE INVENTION

The present invention relates generally to an apparatus to be utilized to simulate flora and, in particular to simulate life-sized palm trees.

For many, the presence of palm trees provides an enchantment rarely provided by other flora. For those who live in a tropical or semi-tropical environment where the ambient temperature and other essential environmental characteristics remain within ranges compatible with living palm trees, the opportunity to admire palm trees abounds and can be a common everyday experience. For those who are not fortunate enough to live in an environment which is compatible with natural palm trees, their only opportunity to be near and to admire the beauty of palm trees is generally limited either to the viewing of photographs, which provides a poor substitute, or to those generally seldom and short-duration opportunities to personally travel to a more tropical zone.

Although various constructions have previously been utilized to simulate an artificial palm tree, most such creations are confined to interior applications where exposure to the elements, especially the wind, is minimal and, if designed for the exterior, the trees are normally miniaturized in order to avoid the effects of twisting due to severe weathering to which a full-sized palm tree is more susceptible.

SUMMARY OF THE INVENTION

An improved artificial palm tree apparatus is provided for installation in an exterior environment, as shown in FIGS. 1 through 7. The apparatus includes a trunk, which is constructed by wrapping long strips of woven glass fibers saturated with hardenable resin in somewhat random crisscross fashion to simulate the generally rough profile of a natural palm tree. The trunk is formed on a cylindrically or tubularly shaped mandrel covered with a thin layer or sheet of plastic to prevent bonding between the resin and the mandrel. After curing, the mandrel is slidably removed and the outer surface of the trunk is coated with exterior brown and black paints to simulate the appearance of a natural palm tree trunk.

The present invention further includes a cap for telescoping over the upper end of the trunk. The cap is substantially cylindrically shaped and has a plurality of ferrules, having substantially smaller diameters as compared to the cap, that are rigidly secured to the curved outer surface of the cap. Central axes of the ferrules are oriented substantially parallel to the central axis of the cap.

Fronds are formed by oppositely spacing the stems of long, narrow artificial leaves alongside a threaded rod and securing the stems to the rod with greenish-colored, weather-resistant tape. A relatively short anchor portion at one end of each of the fronds is left bare for insertion through and securement to one of the cap ferrules. The anchor portion of each frond is threaded to receive a pair of nuts with opposing nuts tightened against a respective ferrule after placement of the respective frond therein. After installation of one of the fronds in each of the ferrules, the rods are physically bent outwardly and downwardly to simulate natural palm branches.

The present invention is generally installed by burying one end of a cylindrically shaped elongate tube in the ground with the other end thereof extending upwardly for insertion in the cylindrically shaped axial cavity which remains in the trunk after removal of the mandrel from the trunk.

A first modified embodiment of the present invention provides a trunk which is divided into a plurality of shorter sections to facilitate shipment thereof. A coupling, having an outside diameter which is dimensioned to be axially slidably insertible in the trunk cavity, is installed at the juncture between adjacent sections of the trunk. A rib protruding circumferentially around a midpoint of each of the couplings aligns the respective coupling such that approximately one-half of the coupling extends into a respective adjacent trunk section. The ends of the trunk sections are formed such that the associated rib is nested within the splice between the sections such that the rib is substantially concealed from view. Each of the sections is rotatably adjustable relative to each adjacent section such that the rough trunk profile is aligned and thereby further camouflaging the existence of the splice between two adjacent sections.

A second modified embodiment of the present invention includes a cap having a plurality of non-cylindrically shaped receivers that are rigidly secured to the curved outer surface of the cap. Each of the receivers is oriented substantially parallel to the central axis of the cap. Each of the fronds has an insert member at the base end thereof. Each of the base members is dimensioned, shaped, and adapted to be slidably and snuggably received by a respective one of the receivers.

OBJECTS AND ADVANTAGES OF THE INVENTION

Therefore, the principal objects of the present invention are: to provide an apparatus which simulates a life-size palm tree; to provide such an apparatus which can withstand the elements in a permanent, exterior installation; to provide such an apparatus which provides a tropical setting at a non-tropical latitude; to provide such an apparatus having parts which may be installed on existing palm tree trunks; to provide such an apparatus which provides branches which can wave and rustle in a breeze; to provide such an apparatus which is relatively easily assembled and disassembled; to provide such an apparatus which is economical to manufacture, capable of long useful life, and particularly well-adapted for the proposed use thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 9 is a fragmentary view of a cap of a second modified embodiment of a palm tree in accordance with the present invention.

FIG. 10 is a reduced top view of such a palm tree.

FIG. 11 is a fragmentary perspective view of such a palm tree.

FIG. 12 is an enlarged and fragmentary cross-sectional view of a receiver of such a palm tree taken along line 12—12 of FIG. 9.

FIG. 13 is a further enlarged and fragmentary cross-sectional view, taken along line 13—13 of FIG. 12, of such a palm tree in accordance With the present invention.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
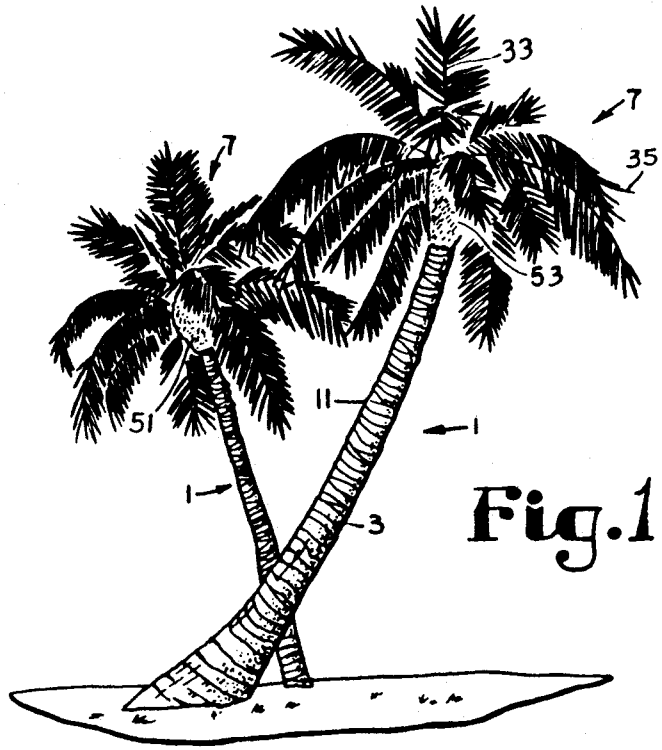
FIG. 1 is a perspective view of palm trees in accordance with the present invention.
Figure 6:
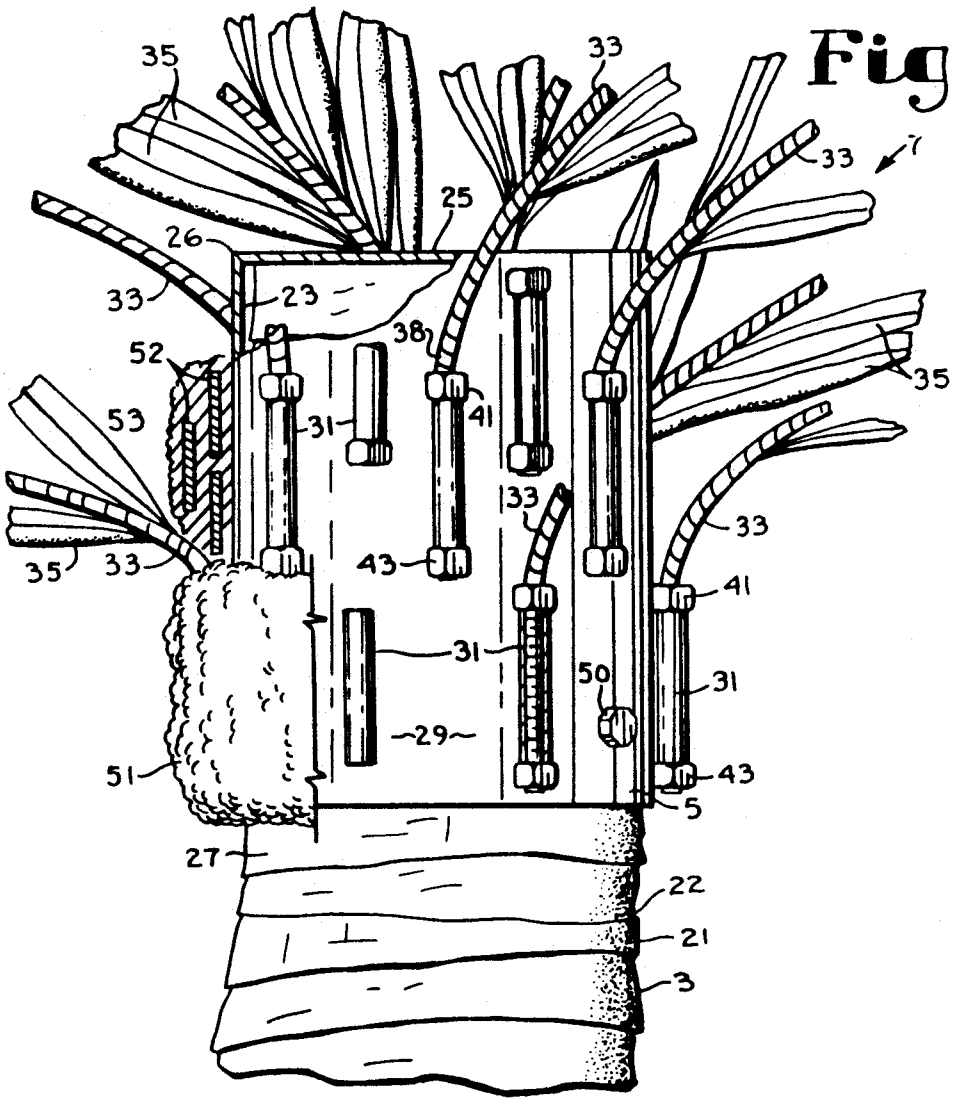
FIG. 6 is an enlarged and fragmentary view of a cap of the palm tree, with portions cut away to reveal details thereof.

The reference numeral 1 generally designates a palm tree in accordance with the present invention that is adapted for exterior installation or the like, such as that shown in perspective in FIG. 1 The palm tree 1 comprises a trunk 3, a cap 5, as is shown in FIG. 6, a plurality of fronds 7 and installation means for installing and supporting the trunk 3, such as a support tube 9.

The trunk 3 has substantially the life-sized dimensions of a living palm tree of the particular species imitated and is constructed of materials suitable for exterior use, such as glass fibers or glass flakes 11, such as that marketed under the trademark Fiberglas by Owens-Corning Fiberglas Corp., or the like, as hereinafter described. A cylindrically shaped mandrel or tube 13 is covered with a thin sheet or layer 15 of plastic, such as flexible polyvinylchloride, or other suitable material. The layer 15 prevents adherence of the glass fibers 11 to the tube 13 and thereby facilitates removal of the tube 13 from the trunk 3 for reuse. In one application of the present invention, the tube 13 was constructed of rigid polyvinylchloride with a diameter of four inches and the glass fibers 11 were applied in long strips approximately four inches wide.

Figure 2:
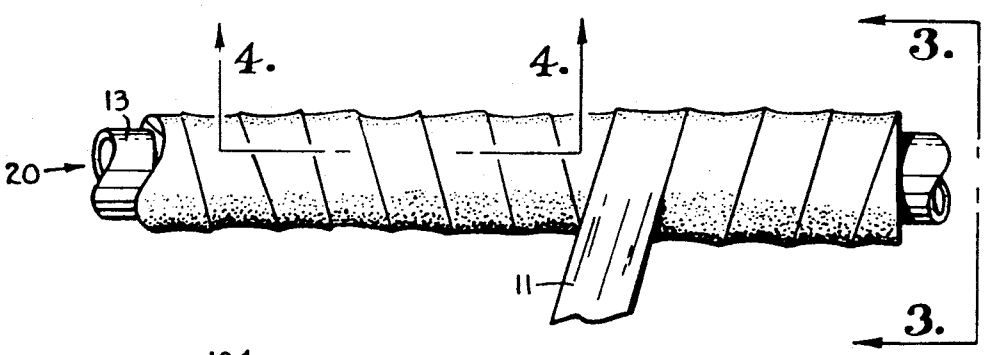
FIG. 2 is an enlarged and fragmentary side elevational view of a partially constructed trunk of such a palm tree.
Figure 3:
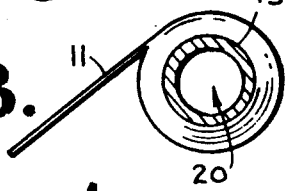
FIG. 3 is a cross-sectional view of the palm tree trunk during construction, taken along line 3—3 of FIG. 2.
Figure 4:
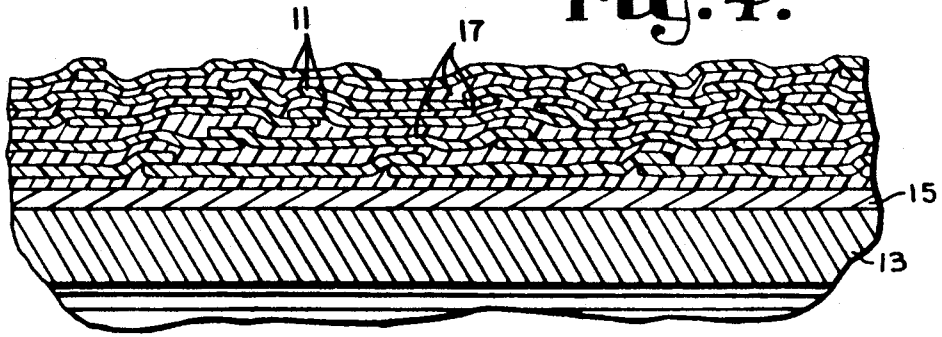
FIG. 4 is an enlarged and fragmentary cross-sectional view of the palm tree trunk during construction, taken along line 4—4 of FIG. 2.

To form the trunk 3, the glass fibers 11 are saturated with and embedded in an appropriate, hardenable resin 17, a method well-known in the art, and is substantially randomly applied in a crisscross fashion exteriorally over the layer 15 as the tube 13 is slowly rotated, as shown in FIGS. 2 and 3. This procedure is continued until the tube 13 and the layer 15 are substantially covered with a plurality of layers of the glass fibers 11, as shown in FIG. 4. The randomness of the placement of the layers of the glass fibers 11 provides the trunk 3 with a rough profile in order to simulate the appearance of the trunk of a natural palm tree. If substantial asymmetry about the axis of the trunk 3 is desired, such as that referenced by the wider base region 19 in FIG. 7, multiple layers of the glass fiber 11 having arbitrary sizes and shapes can be applied exteriorally to provide the desired asymmetry. After the resin 17 has set and bonded the strips of glass fibers 11 into an integral unit, the tube 13 is withdrawn along the central axis thereof, leaving a cylindrically shaped cavity 20 substantially along the major axis of the trunk 3. In one application of the present invention, the trunk 3 had a length of over fourteen feet.

The trunk 3 is then finished, such as by coating, painting, or the like, to closely approximate the appearance of a trunk of a natural palm tree. In one application of the present invention, the trunk 3 was first coated with a flat medium brown paint. The trunk 3 was then sparsely coated with randomly spaced patches of flat black paint. Finally, another partial coat of flat medium brown paint was applied to the trunk 3 with a short-napped roller in order to substantially coat only the outermost portions of the rough profile of the trunk 13, such as that referenced by the numeral 21 in FIG. 6, but leaving some of the innermost portions of the rough profile of the trunk 13 colored black, such as that referenced by the numeral 22 in FIG. 6.

The cap 5 has a substantially cylindrical sidewall 23 and a top 25. The sidewall 23 and the top 25 are constructed of steel or other suitable material. A juncture 26 between the sidewall 23 and the top 25 is water-tight to prevent moisture from penetrating into the cavity 20 when the cap 5 is installed on the trunk 3 as hereinafter described. The inside diameter of the cap 5 is dimensioned larger than the outside diameter of an upper end 27 of the trunk 3 such that the cap 5 can be telescoped over the upper end 27, as is shown in FIG. 6. In one application of the present invention, the cap 5 had an inside diameter of approximately 5 inches.

Rigidly secured to an outer peripheral surface 29 of the cap 5 are attachment means, such as a plurality of cylindrically shaped tubes or ferrules 31 constructed of steel or other suitable material, as shown in FIG. 6. The central axis of each of the ferrules 31 is substantially parallelly aligned with the central axis of the cap 5. The ferrules 31 are randomly spaced and positioned about the surface 29. In one application of the present invention, there were fourteen of the ferrules 31, each having a length of four inches and an inside diameter of three-eighths inch.

Figure 5:
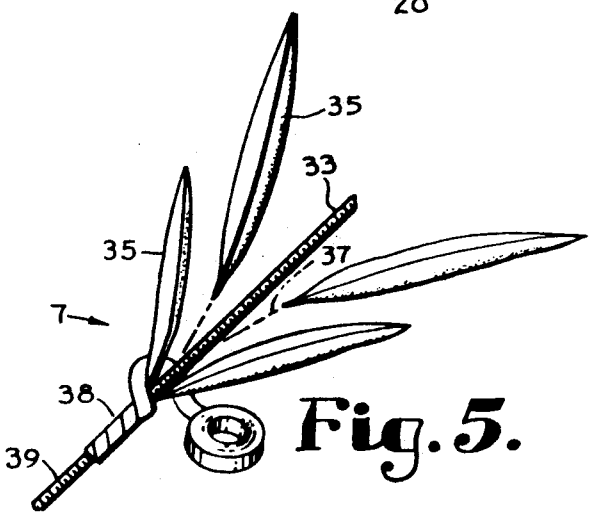
FIG. 5 is an enlarged and fragmentary view of a partially constructed frond of the palm tree during construction.

Each of the fronds 7 has substantially life-sized dimensions and is constructed of materials suitable for exterior use. Each of the fronds 7 comprises a limb 33, such as a semi-rigid threaded rod or the like, and a plurality of long, narrow, artificial leaves 35, such as artificial palm leaflets as provided by the Geller Group, Hollywood, Calif., or the like. Preferably, the leaves 35 are constructed of polyvinylchloride having a stabilizer to prevent hardening, an ultraviolet inhibitor, an anti-fungicide, and an anti-oxidant. Each of the leaves 35 has a stem 37, as shown in FIG. 5. In one application of the present invention, the stem 37 was constructed of 20-gauge, vinyl covered (fused), low-carbon, hard bright steel.

Each of the fronds 7 has a base portion 39, as shown in FIG. 5. The fronds 7 are constructed by diametrically staggering the leaves 35 at substantially one-inch spacings along the entire length of the limb 33, excepting only the base portion 39, and securing the leaves 35 to the limb 33 by spirally wrapping the respective stems 37 and the limb 33 with a green-colored, substantially weather resistant, pressure sensitive tape 38, such as that provided by Geller Group, Inc., Hollywood, Calif., or the like.

In one application of the present invention, the base portion 39 was approximately five inches in length, the limb 33 was constructed of three-eighths-inch threaded rod, and the frond 7 contained eighty-six of the leaves 35. The fronds 7, installed in the ferrules 31 spaced farthest from the top 25, were approximately six feet in length. The fronds 7 installed in ferrules 31 spaced closer to the top 25 were progressively shorter and the fronds 7 installed nearest the top 25 had the shortest limbs 33.

Each of the fronds 7 includes securement means for securing same to the cap 5, such as a first nut 41 and a second nut 43. The first nut 41 is threadedly received on and advanced along the base portion 39 until the nut 41 substantially abuts the tape 38. The base portion 39 of the frond 7 is then slidably inserted downwardly through one of the ferrules 31 until the nut 41 abuts a top of the respective ferrule 31. The second nut 43 is then threadedly received on and advanced along the base portion 39 until snugly urged against a lower edge thereof, such that the respective ferrule 31 is wedged between the opposed nuts 41 and 43.

Alternatively, one or both ends of each of the ferrules 31 may be slanted or notched, or lock washers (not shown) may be utilized between the nuts 41, 43 and the ferrules 31, to resist rotational movement of the limb 33 relative to the respective ferrule 31, when the frond 7 is subjected to normal buffeting forces of winds in an exterior environment. In one application of the present invention, the fronds 7 successfully withstood winds of 60-65 miles per hour without noticeable damage thereto.

A plurality of the fronds 7 are similarly installed until one of the fronds 7 is installed in each of the ferrules 31, with the longest of the fronds 7 being installed in the ferrules 31 spaced farthest from the top 25 and the shortest of the fronds 7 being installed in the ferrules 31 spaced closest to the top 25.

The support tube 9 is cylindrically shaped and has an outside diameter slightly smaller than the inside diameter of the cavity 20 such that the support tube 9 can be slidedly inserted in the cavity 20 of the trunk 3. The support tube 9 is constructed of plastic pipe, steel pipe, or other suitable material such that the tube 9 has sufficient strength and durability to withstand the stresses commensurate with the transverse wind forces existing at any particular location where the palm tree apparatus 1 is to be installed. The support tube 9 has a base portion 45 embedded in soil or the like and a trunk portion 47.

Figure 7:
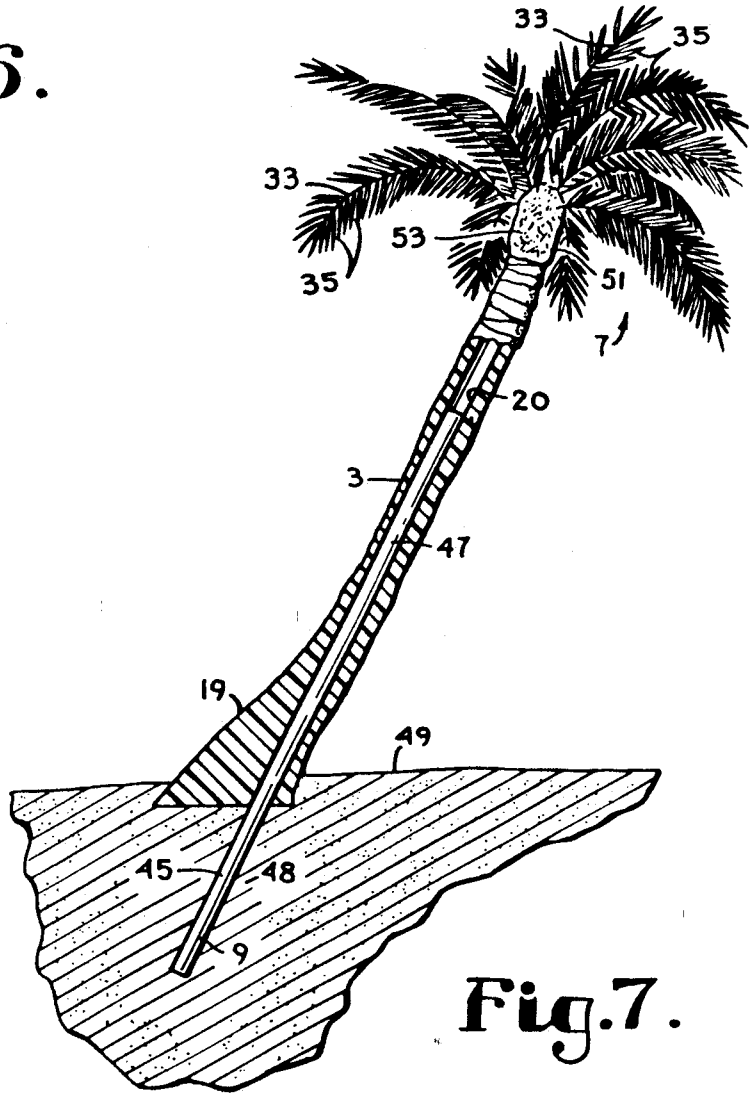
FIG. 7 is an enlarged view of the palm tree, similar to that of FIG. 1 with portions broken away to reveal a support tube in accordance with the present invention.

In an actual application of the present invention, a site is selected for installation of the palm tree apparatus 1. The base portion 45 of the support tube 9 is embedded in the ground or other underlying supporting structure, as shown in FIG. 7, such that the trunk portion 47 extends upwardly from the ground. If necessary, the soil 48 surrounding the support tube 9 can be further stabilized as required with grout, compacted sand, concrete, or the like, to provide sufficient integrity for the support tube 9 to endure the buffeting which breezes and winds will exert on the palm tree apparatus 1.

The support tube 9 may be installed vertically or at an angle to provide a more natural appearance, as shown in FIG. 7. If the trunk 3 is longer than desired for a particular application, the excess can either be excised or buried in the ground 49, as is shown in FIG. 7. In one application of the present invention, the base portion 45 of the support tube 9 had a length of approximately three feet and the trunk portion 47 had a length of approximately six feet, giving an overall length of nine feet for the support tube 9.

After properly installing the support tube 9, the trunk 3 is hoisted and slidably telescoped over the upwardly extending end of the trunk portion 47 of the support tube 9 until the trunk 3 abuts the underlying ground 49.

Then the cap 5, with its plurality of the fronds 7 installed in the respective ferrules 31 as hereinbefore described, is hoisted and telescoped over the upper end 27 of the trunk 3. If necessary to prevent rotational movement between the cap 5 and the trunk 3, the cap 5 may be rigidly secured to the trunk 3, such as by installing one or more lag bolts 50, as shown in FIG. 6.

After the cap 5 is installed on the upper end 27 of the trunk 3, each of the limbs 33 is arcuately bent outwardly and downwardly from the cap 5 with the limbs 33 installed in the ferrules 31 spaced farthest from the top 25 being bent to a greater extent, the limbs 33 installed in the ferrules 31 spaced closest to the top 25 being bent the least, and the limbs 33 installed in the intermediately spaced ferrules 31 being bent outwardly and downwardly in such a manner that a naturally appearing separation remains between the fronds 7 installed in the various ferrules 31 of the cap 5.

To complete the installation, a shroud or sheath 51, constructed of strips of coarse meshed fabric such as burlap 52 or the like, intertwined with natural coconut fiber 53, such as 100% coir fiber as provided by Austram, Inc., as is shown in FIG. 6, is wrapped around the cap 5 such that the cap 5, the ferrules 31, and the nuts 41 and 43 are substantially camouflaged and concealed from view, with the limbs 33 and the leaves 35 of the fronds 7 protruding therethrough. In one application of the present invention, the strips of burlap 51 were two to three inches wide and approximately twelve feet long. The installed burlap 51 and the fiber 53 are then sprayed with an adhesive spray, such as Super 77 Aerosol Adhesive as provided by 3M Company, or the like, to provide sufficient securement to withstand the hostile effects of the wind and elements in an outside, unprotected environment.

Alternatively, the artificial palm tree apparatus 1 can be installed in a portable configuration. For that application, the support tube 9 is generally constructed of steel and comprises only the trunk portion 47, the lower end of which is welded or otherwise rigidly secured to a base plate (not shown). The base plate must be sufficiently massive to provide the necessary ballast to withstand the lateral forces to which the artificial palm tree apparatus 1 may be subjected or alternatively fixedly attached to a ground support structure such as a buried concrete block. Typical base plates comprise approximately 25 square feet of steel plate having a thickness of three-eighths to one-half inch. If more than one of the artificial palm trees 1 are secured to the same base plate, the respective support tubes 9 may be installed at a variety of inclined angles such that the artificial palm trees 1 have a more natural appearance, such as that shown in FIG. 1, with the torque generated by one of the leaning palm trees 1 at least partially countering the torque generated by the other leaning palm tree 1.

Another application of the present invention involves installing the cap 5, with the fronds 7 positioned therein as hereinbefore described, on an existing palm tree trunk, whether living or dead. In that event, the anchoring and support, which would otherwise have been provided by the support tube 9, is provided by such an existing palm tree trunk.

Figure 8:
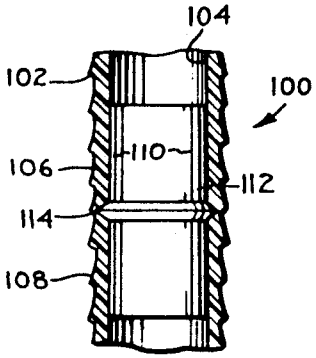
FIG. 8 is an enlarged and fragmentary cross-sectional view of a first modified embodiment of a palm tree in accordance with the present invention.

A first modified artificial palm tree apparatus in accordance with the present invention is shown in FIG. 8 and is generally designated by the reference numeral 100. Many of the characteristics of the modified palm tree apparatus 100 are substantially similar to those already described for the apparatus 1 and will not be reiterated here in detail.

To facilitate shipping, a trunk 102 having a cylindrically shaped cavity 104 is severed into two or more sections, such as sections 106 and 108, as shown in FIG. 8. A coupling 110 is snugly received in the cavity 104 in both sections 106 and 108 and is utilized to connect adjoining sections, such as the sections 106 and 108, together as hereinafter described. The coupling 110 is generally cylindrically shaped with an outside diameter smaller than the diameter of the cavity 104. A rib 112 protrudes circumferentially from the coupling 110 intermediate to the ends of the coupling 110. Adjoining ends of the sections 106 and 108 are formed to concealingly receive the rib 112 of the coupling 110.

During installation, the bottommost section, such as section 108 shown in FIG. 8, is first installed. Then, one end of the coupling 110 is inserted into the cavity 104 of the section 108 until the rib 112 abuts the distal end of the section 108. The lower end of the section 106 is then telescoped over the upwardly extending end of the coupling 110 until the lower end of the section 106 substantially abuts the upper end of the section 108, forming a splice 114 therebetween.

A similar procedure is utilized to install one of the couplings 110 to splice together other adjoining sections of the trunk 102 until the entire trunk 102 is assembled. Adjacent sections, such as the sections 106 and 108, can be rotated relative to each other such that the rough profile lines of the trunk 102 match, thereby minimizing or eliminating visible evidence of the splice 114 between the adjacent sections 106 and 108. Small lag bolts (not shown) may be used to secure the sections 106 and 108 to the coupling 110 to prevent relative rotational movement between the sections 106 and 108 after completion of the installation.

A second modified artificial palm tree apparatus in accordance with the present invention is shown in FIGS. 9 through 13 and is generally designated by the reference numeral 150. Many of the characteristics of the second modified palm tree apparatus 150 are substantially similar to those already described for the embodiments hereinbefore described and will not be reiterated here in detail.

A cap 152 has a substantially cylindrical sidewall 154 and a top 156. Rigidly secured to an outer peripheral surface 158 of the cap 152 are attachment means, such as a plurality of receivers 160 constructed of iron or other suitable material, as shown in FIG. 9. The receivers 160 may be secured to the cap 152 by welding or other suitable means.

The longitudinal axis of each of the receivers 160 is substantially parallelly aligned with the central axis of the cap 152. The receivers 160 are randomly spaced and positioned about the surface 158. Preferably, each of the receivers 160 is non-cylindrically shaped, such as the angular configuration, as shown in FIG. 11. In addition, an upper end 162 of each of the receivers 160 is tapered downwardly and outwardly from the surface 158, forming a notch 163, as shown in FIG. 12. In one application of the present invention, each of the receivers 160 had a length of approximately three inches. A small mound 164, such as a small portion of a welding rod, is rigidly attached to the surface 158 immediately below each of the receivers 160, as shown in FIG. 12.

Each of a plurality of fronds 165 comprises a limb 166, such as three-eighths-inch-diameter, semi-rigid steel rod or the like, and an insert member 168. Each of the insert members 168 is welded or otherwise rigidly secured to a base end 170 of a respective one of the limbs 166. The insert member 168 is smaller than and similarly shaped to a cavity 174 formed between each of the receivers 160 and the sidewall 154 such that the insert member 168 is slidably and snugly received in the cavity 174, as indicated in FIG. 11. The base end 170 of the frond 165 rests against the mound 164 to prevent any tendency for the insert member 168 to move downwardly through the respective receiver 160 as the respective frond 165 is exposed to a hostile exterior environment.

After installing the cap 152 on a trunk 172 of the apparatus 150 as hereinbefore described for another embodiment, one of the fronds 165 is installed in a respective one of each of the receivers 160. Each of the limbs 166 of the installed fronds 165 is then bent outwardly and downwardly, as indicated by the limb 176 shown in phantom in FIG. 12.

It is to be understood that while certain forms of the present invention have been illustrated and described herein, it is not to be limited to the specific forms or arrangement of parts described and shown.

What is claimed and desired to be secured by Letters Patent is as follows:

1. An artificial palm tree structure for being supported by a supporting structure, comprising:

(a) a trunk having a cylindrical shaped and axially extending axial cavity; said trunk having substantially life-sized dimensions, said trunk constructed of materials adapted for exterior use;

(b) a plurality of fronds for simulating branches for said palm tree apparatus; said fronds having substantially life-sized dimensions; said fronds constructed of materials adapted for exterior use; said fronds each having first structure means, including semi-rigid stem, such that said fronds are capable of withstanding the buffeting forces of wind normally found in an exterior environment;

(c) attachment means having second structure means such that said attachment means is secured both to said trunk and to each of said fronds such that said attachment means are capable of withstanding said buffeting forces; and (d) installation means for installing and supporting said trunk in an exterior environment.

2. The artificial palm tree structure according to claim 1, wherein said trunk is constructed of multiple layers of glass fibers embedded in a hardened resin such that said layers are randomly spaced to simulate the rough profile of a natural palm tree trunk.

3. The artificial palm tree structure according to claim 2, wherein said trunk has a length of at least 14 feet.

4. The artificial palm tree structure according to claim 2, including:

(a) multiple layers of glass fibers embedded in a hardened resin secured near a lower end of said trunk; said layers having arbitrary sizes and shapes such that an asymmetry is provided about the axis of said trunk.

5. The artificial palm tree structure according to claim 1, wherein each of said fronds includes:

(a) a limb;

(b) a plurality of artificial leaves secured to said limb; and (c) securement means for securing said limb to said attachment means.

6. The artificial palm tree structure according to claim 5, wherein:

(a) each of said limbs comprises a cylindrical, semi-rigid rod having threads near one end thereof; and (b) said securement means includes at least one ferrule having an inner diameter adapted to receive a threaded end of said rod therein and a pair of opposed nuts threadedly secured to said rod for tightening against opposite ends of said ferrule.

7. The artificial palm tree structure according to claim 5, wherein:

(a) said attachment means includes a cap for telescoping over an upper end of said trunk; and (b) said securement means includes a plurality of ferrules randomly spaced about and secured to an outer peripheral surface of said cap; each of said ferrules operably securing a respective one of said limbs.

8. The artificial palm tree structure according to claim 1, wherein each of said fronds includes:

(a) a limb; each of said limbs comprises a cylindrical, semi-rigid rod having a non-cylindrically shaped insert member at a base end thereof;

(b) a plurality of artificial leaves secured to said limb; and wherein (c) said attachment means includes at least one receiver adapted to operably receive said insert member therein.

9. The artificial palm tree structure according to claim 8, wherein said attachment means includes a cap for telescoping over an upper end of said trunk; said cap having a plurality of said receivers randomly spaced about and secured to an outer peripheral surface of said cap; each of said receivers operably receiving said insert member of a respective one of said limbs.

10. The artificial palm tree structure according to claim 1, wherein said installation means includes a cylindrically shaped tube; said tube having a base portion for securement to the supporting structure and a trunk portion for insertion in said cavity of said trunk.

11. The artificial palm tree structure according to claim 1, including:

(a) at least one coupling, said coupling having two ends and a medially positioned, outwardly extending rib; said ends having diameters dimensioned to be snugly received in said cavity;

(b) said trunk having at least two sections; each one of said sections receiving a different one of said ends such that said sections abut each other, substantially concealing said rib therebetween; and (c) securement means for securing said trunk sections to said coupling having third structure means such that said palm tree structure is capable of withstanding said buffeting forces.

12. An artificial palm tree structure for being supported by a supporting structure, comprising:

(a) a trunk constructed of multiple layers of glass fiber strips embedded in hardened resin; said strips randomly spaced in a generally crisscross fashion to simulate the rough profile of a natural palm tree; said trunk having a generally axial, cylindrically shaped cavity; said trunk having substantially life-sized dimensions;

(b) a cap having a top and a cylindrically shaped sidewall; said top rigidly secured to one end of said sidewall to form a generally watertight joint therebetween; said sidewall having an inner diameter dimensioned to receive an upper end of said trunk such that said cap is slidably telescopable over said upper end of said trunk; said sidewall having a plurality of cylindrically shaped ferrules rigidly and randomly secured to the outer surface of said sidewall such that the axes of said ferrules are oriented substantially parallel to the axis of said cap;

(c) a plurality of fronds having substantially life-sized dimensions; each of said fronds comprising a semi-rigid rod having a threaded base portion with two nuts threadedly secured thereto and a plurality of artificial leaves having stems; said leaves constructed of polyvinylchloride having a stabilizer to prevent hardening, an ultraviolet inhibitor, an anti-fungicide, and an anti-oxidant; said leaves diametrically spaced along said rod and the respective stems rigidly secured to said rod with substantially weather-resistant, pressure-sensitive tape; said base portion of each of said rods slidably inserted through a respective one of said ferrules and rigidly secured thereto by tightening the respective nuts against opposing ends of the respective ferrule;

(d) a shroud comprising strips of burlap intertwined with natural fibers; said shroud secured to and camouflaging said cap, said ferrules, and said nuts;

(e) a cylindrically shaped support tube having an outside diameter dimensioned to be received in said trunk cavity; said support tube having a base portion and a trunk portion such that said base portion can be embedded in the supporting structure and said trunk portion can be inserted into said cavity; and (f) said trunk, said cap, said plurality of fronds, said shroud, and said support tube having structure means such that said palm tree structure is capable of withstanding the buffeting forces of wind normally found in an exterior environment.

13. The artificial palm tree structure of claim 12 wherein:

(a) said trunk comprises at least two sections abuttingly spaced end to end; and including (b) a substantially cylindrically shaped coupling having securement means for rigid securement to said sections; said coupling having a circumferential rib spaced substantially at a mid-point between the ends of said coupling such that said rib is concealingly received by said sections.

14. The artificial palm tree structure according to claim 12, including:

(a) multiple layers of glass fibers embedded in hardened resin secured near a lower end of said trunk;

said layers having arbitrary sizes and shapes such that an asymmetry is provided about the axis of said trunk.

15. An artificial palm tree structure for being supported by a supporting structure, comprising:

(a) a trunk constructed of multiple layers of glass fiber strips embedded in hardened resin; said strips randomly spaced in a generally crisscross fashion to simulate the rough profile of a natural palm tree; said trunk having a generally axial, cylindrically shaped cavity; said trunk having substantially life-sized dimensions;

(b) a cap having a top and a cylindrically shaped sidewall; said top rigidly secured to one end of said sidewall to form a generally watertight joint therebetween; said sidewall having an inner diameter dimensioned to receive an upper end of said trunk such that said cap is slidably telescopable over said upper end of said trunk; said sidewall having a plurality of non-cylindrically shaped receivers rigidly and randomly secured to the outer surface of said sidewall such that the axes of said receivers are oriented substantially parallel to the axis of said cap;

(c) a plurality of fronds having substantially life-sized dimensions; each of said fronds comprising a semi-rigid rod having a base portion with an insert member and a plurality of artificial leaves having stems; said leaves constructed of polyvinylchloride having a stabilizer to prevent hardening, an ultraviolet inhibitor, an anti-fungicide, and an anti-oxidant; said leaves diametrically spaced along said rod with respective said stems rigidly secured to said rod with substantially weather-resistant, pressure-sensitive tape; each of said insert members slidably received within a respective one of said receivers;

(d) a shroud comprising strips of burlap intertwined with natural fibers; said shroud secured to and camouflaging said cap and said receivers;

(e) a cylindrically shaped support tube having an outside diameter dimensioned to be received in said trunk cavity; said support tube having a base portion for embedding in an underlying supporting structure and a trunk portion such that said base portion can be embedded in the supporting structure and said trunk portion can be inserted into said cavity; and (f) said trunk, said cap, said plurality of fronds, said shroud, and said support tube having structure means such that said palm tree structure is capable of withstanding the buffeting forces of wind normally found in an exterior environment.

16. The artificial palm tree structure of claim 15 wherein:

(a) said trunk comprises at least two sections abuttingly spaced end to end; and including (b) a substantially cylindrically shaped coupling having securement means for rigid securement to said two sections; said coupling having a circumferential rib spaced substantially at a mid-point between the ends of said coupling such that said rib is concealingly received by said sections as secured thereto.

17. The artificial palm tree structure according to claim 15, including:

(a) multiple layers of glass fibers embedded in hardened resin secured near a lower end of said trunk; said layers having arbitrary sizes and shapes such that an asymmetry is provided about the axis of said trunk.

* * * * *